US010371489B2

(12) United States Patent
Wall et al.

(10) Patent No.: US 10,371,489 B2
(45) Date of Patent: Aug. 6, 2019

(54) BULLET DECELERATION TRAY DAMPING MECHANISM

(71) Applicant: Action Target Inc., Provo, UT (US)

(72) Inventors: Darren Wall, Payson, UT (US); Kevin Tomaszewski, Draper, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 15/388,733

(22) Filed: Dec. 22, 2016

(65) Prior Publication Data

US 2017/0205210 A1 Jul. 20, 2017

Related U.S. Application Data

(60) Provisional application No. 62/279,221, filed on Jan. 15, 2016.

(51) Int. Cl.
*F41J 13/00* (2009.01)

(52) U.S. Cl.
CPC ..... *F41J 13/00* (2013.01)

(58) Field of Classification Search
CPC ..... F41J 13/00
USPC ..... 273/404, 410
See application file for complete search history.

(56) References Cited

U.S. PATENT DOCUMENTS

| | | | |
|---|---|---|---|
| 197,398 | A | 11/1877 | O'neil |
| 385,546 | A | 7/1888 | Decumbus |
| 570,820 | A | 11/1896 | Scratton |
| 694,581 | A | 3/1902 | Reichlin |
| 840,610 | A | 1/1907 | Easdale |
| 941,642 | A | 11/1909 | Maxim |
| 980,255 | A | 1/1911 | Herms et al. |
| 1,035,908 | A | 8/1912 | Richardson |
| 1,155,717 | A | 10/1915 | Fouts |
| 1,704,731 | A | 8/1929 | Bernhard |
| 1,728,046 | A | 9/1929 | Duerr |
| 1,767,248 | A | 6/1930 | Leach |
| 2,013,133 | A | 9/1935 | Caswell |
| 2,039,602 | A | 5/1936 | Leubbe |
| 2,054,665 | A | 9/1936 | Tracy |
| 2,201,527 | A | 5/1940 | Freeman |
| 2,350,827 | A | 6/1944 | Saulnier |
| 2,411,026 | A | 11/1946 | Conner et al. |
| 2,420,304 | A | 5/1947 | Diem |
| 2,518,445 | A | 8/1950 | Benson |
| 2,631,454 | A | 3/1953 | Shepard et al. |
| 2,670,959 | A | 3/1954 | Broyles |
| 2,713,262 | A | 7/1955 | Webster |
| 2,772,092 | A | 11/1956 | Nikoden |

(Continued)

FOREIGN PATENT DOCUMENTS

| | | |
|---|---|---|
| DE | 20 21 170 | 11/1971 |
| DE | 32 12 781 | 10/1983 |

(Continued)

OTHER PUBLICATIONS

Caswell International Corp., Bullet Trap Design, Circa 2002.

(Continued)

*Primary Examiner* — Mark S Graham
(74) *Attorney, Agent, or Firm* — Durham Jones & Pinegar; Christopher L. Wight; Randall B. Bateman

(57) ABSTRACT

A bullet trap is disclosed which comprises a vibration dampening gasket disposed between the impact plates and support frame.

18 Claims, 8 Drawing Sheets

(56) References Cited

U.S. PATENT DOCUMENTS 3,233,904 A 2/1966 Gillam et al.
3,265,226 A 8/1966 Malcolm
3,278,667 A 10/1966 Knox
3,300,032 A 1/1967 Lucien
3,323,800 A 6/1967 Lindsay
3,404,887 A 10/1968 Dundr
3,447,806 A 6/1969 Pfaff et al.
3,508,302 A 4/1970 Settanni
3,567,223 A 3/1971 Gentiluomo
3,673,294 A 6/1972 Matthaei
3,701,532 A 10/1972 Nikoden
3,737,165 A * 6/1973 Pencyla ..... F41J 13/00 273/410
3,982,761 A 9/1976 DeVogelaere
4,126,311 A 11/1978 Wagoner
4,201,385 A * 5/1980 Szabados ..... F41J 13/02 273/410
4,272,078 A 6/1981 Vinette
4,317,572 A 3/1982 Iseli
4,445,693 A 5/1984 Angwin
4,458,901 A 7/1984 Wojcinski
4,479,048 A 10/1984 Kinoshita
4,509,301 A 4/1985 Head
4,512,585 A 4/1985 Baravaglio
4,589,792 A 5/1986 Niziol
4,638,546 A 1/1987 Benshoof
4,677,798 A 7/1987 Phillips
4,683,688 A 8/1987 Wojcinski
4,706,963 A 11/1987 Guess
4,717,308 A 1/1988 Kuhns
4,728,109 A 3/1988 Simonetti
4,743,032 A 5/1988 Summers et al.
4,786,059 A 11/1988 Barini
4,787,289 A 11/1988 Duer
4,819,946 A 4/1989 Kahler
4,821,620 A 4/1989 Cartee et al.
4,846,043 A 7/1989 Langsam
4,856,791 A 8/1989 McQuade
4,890,847 A 1/1990 Cartee et al.
4,919,437 A 4/1990 Salabé et al.
5,006,995 A 4/1991 Toschi et al.
5,040,802 A 8/1991 Wojcinski et al.
5,070,763 A 12/1991 Coburn
5,085,765 A 2/1992 Salabé et al.
5,088,741 A 2/1992 Simonetti
5,113,700 A 5/1992 Coburn
5,121,671 A 6/1992 Coburn
D329,680 S 9/1992 Burn
5,163,689 A 11/1992 Bateman
5,171,020 A 12/1992 Wojcinski
5,213,336 A 5/1993 Bateman
5,232,227 A 8/1993 Bateman
5,240,258 A 8/1993 Bateman
5,242,172 A 9/1993 Bateman
5,255,924 A 10/1993 Copius
5,259,291 A 11/1993 Wilson
5,277,432 A 1/1994 Bateman
5,333,557 A 8/1994 Eickhoff
5,340,117 A 8/1994 Wojcinski
5,366,105 A 11/1994 Kerman et al.
5,367,860 A 11/1994 Cullen
5,400,692 A * 3/1995 Bateman ..... F41J 13/00 273/410
5,405,673 A 4/1995 Seibert
5,435,571 A 7/1995 Wojcinski et al.
5,441,280 A 8/1995 Copius
5,443,352 A 8/1995 Schumacher
5,456,155 A 10/1995 Myrtoglou
5,486,008 A 1/1996 Coburn
5,535,662 A 7/1996 Bateman
5,542,616 A 8/1996 Archer
5,564,712 A 10/1996 Werner
5,607,163 A 3/1997 Nesler
5,618,044 A 4/1997 Bateman
5,655,775 A 8/1997 Pontus et al.
5,684,264 A 11/1997 Cassells et al.
5,715,739 A 2/1998 White
5,718,434 A 2/1998 Alward
5,738,593 A 4/1998 Coury et al.
5,811,164 A 9/1998 Mitchell
5,811,718 A 9/1998 Bateman
5,822,936 A 10/1998 Bateman
5,848,794 A 12/1998 Wojcinski et al.
5,901,960 A 5/1999 Nesler et al.
5,951,016 A 9/1999 Bateman
5,988,647 A 11/1999 Embrey et al.
6,000,700 A 12/1999 Nesler et al.
6,009,790 A 1/2000 Tekorius
6,016,735 A 1/2000 Langner
6,027,120 A 2/2000 Wojcinski et al.
6,162,057 A 12/2000 Westphal et al.
6,173,956 B1 1/2001 O'Neal
6,245,822 B1 6/2001 Terada et al.
6,268,590 B1 7/2001 Gale et al.
6,293,552 B1 9/2001 Wojcinski et al.
6,311,980 B1 11/2001 Sovine et al.
6,341,708 B1 1/2002 Palley et al.
6,350,197 B1 2/2002 Cooksey
6,363,867 B1 4/2002 Tsilevich
6,378,870 B1 4/2002 Sovine
6,415,557 B1 7/2002 McCalley
6,484,990 B1 11/2002 Marshall
6,533,280 B1 3/2003 Sovine et al.
6,588,759 B1 7/2003 Bateman
6,722,195 B2 4/2004 Duke
6,732,628 B1 5/2004 Coburn et al.
RE38,540 E 6/2004 Bateman
6,776,418 B1 8/2004 Sovine et al.
6,808,178 B1 10/2004 Sovine
6,910,254 B2 6/2005 Aoki et al.
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,469,903 B2 12/2008 Marshall et al.
7,497,441 B2 3/2009 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
7,914,004 B2 3/2011 Wright et al.
7,950,666 B2 5/2011 Stincelli et al.
8,016,291 B2 9/2011 Wright et al.
8,091,896 B2 1/2012 Lambert et al.
8,128,094 B2 3/2012 Lambert et al.
8,162,319 B2 4/2012 Stincelli et al.
8,276,916 B2 10/2012 Bateman et al.
8,313,103 B2 11/2012 O'Neal et al.
8,469,364 B2 6/2013 Bassett et al.
8,485,529 B2 7/2013 Bateman et al.
8,550,465 B2 10/2013 Wright et al.
8,579,294 B2 11/2013 Wright et al.
8,602,418 B1 12/2013 Hering et al.
8,684,361 B2 4/2014 Henson et al.
8,827,273 B2 9/2014 John et al.
8,827,274 B2 * 9/2014 Lamothe ..... F41J 13/00 273/410
9,217,623 B2 12/2015 Sovine et al.
9,228,810 B2 1/2016 Bareman et al.
2002/0088339 A1 7/2002 Koffler
2005/0001381 A1 1/2005 Lambert et al.

(56) References Cited

U.S. PATENT DOCUMENTS

| | | | | |
|---|---|---|---|---|
| 2005/0022658 | A1 | 2/2005 | Bateman | |
| 2005/0034594 | A1 | 2/2005 | Parks et al. | |
| 2006/0107985 | A1 | 5/2006 | Sovine | |
| 2006/0234069 | A1 | 10/2006 | Sovine et al. | |
| 2006/0240388 | A1 | 10/2006 | Marshall et al. | |
| 2006/0240391 | A1 | 10/2006 | Sovine et al. | |
| 2007/0072537 | A1 | 3/2007 | Bateman et al. | |
| 2007/0102883 | A1 | 5/2007 | Parks et al. | |
| 2009/0014961 | A1 | 1/2009 | Bateman et al. | |
| 2009/0096173 | A1* | 4/2009 | Bateman | B23K 11/0053 273/410 |
| 2009/0206551 | A1 | 8/2009 | Parks et al. | |
| 2010/0311015 | A1 | 12/2010 | Sovine et al. | |
| 2011/0037227 | A1 | 2/2011 | O'Neal et al. | |
| 2011/0062667 | A1 | 3/2011 | Medina et al. | |
| 2011/0233869 | A1 | 9/2011 | John et al. | |
| 2012/0038110 | A1* | 2/2012 | Priebe | F41J 13/00 273/410 |
| 2012/0187631 | A1 | 7/2012 | John et al. | |
| 2012/0193872 | A1 | 8/2012 | Henson et al. | |
| 2012/0247314 | A1 | 10/2012 | Bassett et al. | |
| 2013/0207347 | A1 | 8/2013 | Sovine et al. | |

FOREIGN PATENT DOCUMENTS

| | | |
|---|---|---|
| DE | 214 433 | 10/1984 |
| DE | 36 35 741 | 7/1992 |
| EP | 0 399 960 | 11/1990 |
| EP | 0 523 801 | 1/1993 |
| EP | 0 528 722 | 2/1993 |
| GB | 6353 | 1/1909 |
| GB | 2 242 730 | 10/1991 |
| JP | 05241275 A | 9/1993 |
| JP | 10339093 A | 12/1998 |
| WO | WO 85-05672 | 12/1985 |
| WO | WO 94-27111 | 11/1994 |

OTHER PUBLICATIONS

Caswell International Corp., Bullet Trap Product Literature, Circa 2002.
Caswell International Corp., Product Literature, Copyright 2002.
Declaration of Kyle Bateman re Bullet Trap Design Circa 2001.
Duelatron, Product Literature 1995.
www.letargets.com. Breach training door. Circa 2005.
www.mgmtargets.com. Breach training door Circa 2005.
Porta Target, Product Literature, Circa 2000.
Porta Target, Shoot House Product Literature, Circa 2000.
Savage Arms, Shoot House Bid and Specification, Bid dated Oct., 1998.
ST Bullet Containment Sytems, Inc. Product Literature, Circa 2002.
Trussed Concrete Steel Co., Youngstown, Ohio, Copyright 1903, Product Literature.
International Search Report and Written Opinion from PCT Application No. US2011/029685, dated Feb. 9, 2012.

* cited by examiner

BULLET DECELERATION TRAY DAMPING MECHANISM

BACKGROUND OF THE INVENTION

The present invention relates to a bullet trap for receiving and containing projectiles, such as bullets, fired at the bullet trap.

In order to maintain their proficiency with various types of firearms, law enforcement officers and others routinely engage in target practice. For many years, target practice was conducted in environments in which there was little concern for recovering the bullets. Firing ranges commonly used a large mound of dirt to decelerate the bullet after it had passed through the target. Such a system was generally safe, in that the dirt was effective in stopping the bullet and preventing injuries. While the most common projectile at a firing range is a bullet, other projectiles, such as shot, can also be present.

Because of concerns about the lead contained in the bullet, release of the lead into the environment when a bullet fragments upon impact, firing ranges increasingly use bullet containment chambers to capture fired bullets and fragments thereof. Bullets may be recycled or otherwise disposed of in accordance with environmental regulations, thereby significantly reducing the risks of lead escaping into the environment. In addition, bullet containment chambers typically include an opening through which the bullet enters, a deceleration mechanism for slowing the bullet to a stop, and a container mechanism for holding the bullet until it is retrieved from the containment chamber. Either end of the containment chamber includes a sidewall which limits the lateral travel of the projectile. If a projectile impacts the side wall, it may ricochet or, if a high powered round, may puncture the side wall.

Examples of bullet containment chambers can be found in the following patent disclosures: U.S. Pat. Nos. 5,535,662; 7,194,944; 7,775,526; 7,793,937; 7,275,748; 7,306,230; 7,653,979; 8,276,916; and 8,485,529. These containment systems utilize angled impact plates to decelerate bullets. Once the bullets are slowed sufficiently, they fall into a canister mounted below the containment chamber.

The above containment systems, however, suffer from a common problem—the repetitive impact of bullets transfers a significant amount of kinetic energy to the system, which causes structural fatigue, reduces the life of the components of the system and increases the expense of maintenance and repair.

Thus, there is a need for an improved bullet trap which minimizes structural fatigue, extends the life of the bullet trap system and reduces costs.

SUMMARY OF THE INVENTION

The present invention generally relates to a bullet trap device comprising a vibration dampening gasket disposed between an impact plate and a support structure.

In one particular embodiment, the bullet trap comprises a plurality of support frames; one or more impact plate positioned on and supported by the support frame; and a gasket disposed between the one or more impact plate and one or more of the plurality of support frames, wherein the gasket absorbs kinetic energy transferred from the one or more impact plate.

In another embodiment, the vibration dampening gasket isolates the one or more impact plate from the plurality of support frames.

In another embodiment, the gasket is continuously disposed and provides an airtight seal between the one or more impact plate and the support frames.

In another embodiment, the gasket is comprised of a material selected from one or more of the following: closed cell foam, visco-elastic foam, rubber, plastic and silicone. In a particular embodiment, the material is closed cell foam.

In yet another embodiment, the one or more impact plate, plurality of support frames and gasket form a containment chamber.

In yet another embodiment, the bullet trap further comprises an air pump configured to provide negative air flow from within the bullet trap to an air filter configured to remove particulate matter.

In yet another embodiment, the bullet trap further comprises a second gasket positioned between one or more impact plate and one or more upper channel plate and lower channel plate.

BRIEF DESCRIPTION OF THE DRAWINGS

The above and other objects, features and advantages of the invention will become apparent from a consideration of the following detailed description presented in connection with the accompanying drawings in which.

Figure 1:
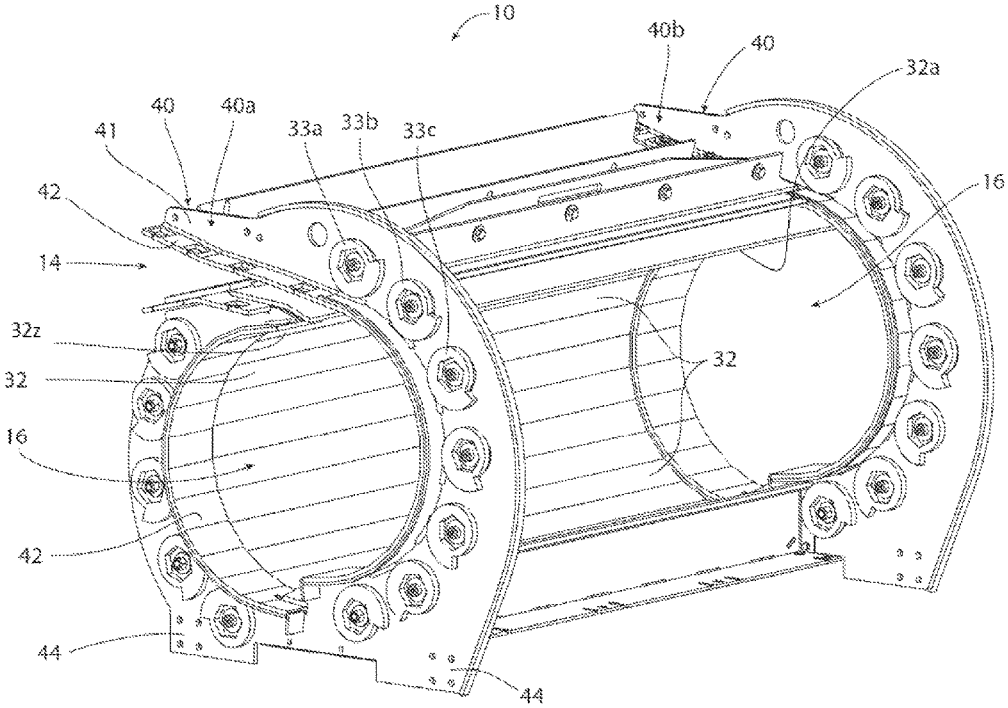
FIG. 1 shows a perspective view of the rear of a bullet trap device.

It is appreciated that not all aspects and structures of the present invention are visible in a single drawing, and as such multiple views of the invention are presented so as to clearly show the structures of the invention.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Additionally, it should be appreciated that the components of the individual embodiments discussed may be selectively combined in accordance with the teachings of the present disclosure. Furthermore, it should be appreciated that various embodiments will accomplish different objects of the invention, and that some embodiments falling within the scope of the invention may not accomplish all of the advantages or objects which other embodiments may achieve.

The present invention is generally directed to a bullet trap configured to absorb kinetic energy transferred to the bullet trap from bullets that impact the bullet trap. Bullet traps generally comprise one or more support frame on which is positioned impact plates that safely stop the trajectory of bullets. Because the impact plates are subject to repetitive impact from high velocity bullets, they absorb a significant amount of kinetic energy and transfer that kinetic energy to the remaining bullet trap structure. This transfer of kinetic energy to the bullet trap structure is the source of significant damage and fatigue to bullet traps, causes weakening of welds and other components of the system, and ultimately results in a significant shortening of the lifespan of the bullet trap and an increase in the cost of maintenance and repair.

As described herein and shown in the figures herein, the various embodiments of the present invention are directed to bullet trap systems having vibration dampening gaskets disposed between the impact plates and the support frames, which isolate the impact plates from the support frames and absorb the kinetic energy of impact from bullets that would otherwise be transferred from the impact plates directly or indirectly to the support frames and other structures (for example, the welds joining the various components of the support frames together, the tightening cams used to secure the impact plates to the support frames, and other support structures). By isolating the impact plates from the other components of the bullet trap system the transfer of kinetic energy from the impact plates to the support frame is reduced, the cost of maintenance and repair is reduced, and the life expectancy of the support frame is increased.

In addition to the aforementioned vibration dampening advantages, the vibration dampening gasket, when continuously disposed between the one or more impact plate and the plurality of support frames, also possesses a secondary advantage, namely, the gaskets seal the connection between the impact plates and the support frame to allow the dust containment unit to more efficiently provide a negative pressure in the bull trap chamber and remove lead dust created by bullet disintegration. Sealing the chamber with replaceable gaskets provides for a more efficient and consistent seal than the prior use of silicone beads along the corners where the impact plates abut against the support frame.

In accordance with one particular embodiment, the bullet trap comprises a plurality of support frames, between which is positioned one or more impact plate that are supported by the support frames. Disposed between the one or more impact plate and one or more of the plurality of support frames is a gasket, which absorbs kinetic energy transferred from the one or more impact plate when a bullet strikes the impact plate.

It is understood that in some embodiments the vibration dampening gasket may be utilized on only one, or a few impact plates. In other embodiments the vibration dampening gasket may be utilized on all of the impact plates used in a given bullet trap. It is not, therefore, necessary that all impact plates must be isolated from the bullet trap system with a vibration dampening gasket. Because certain impact plates directly behind the entry channel of the bullet trap system will be subject to more frequent impact and greater forces, it is advantageous that those impact plates in particular utilize a vibration dampening gasket. In some instances, certain impact plates will receive infrequent bullet hits (or ricocheting bullets or bullet fragments that transmit less kinetic energy) and will benefit to a lesser degree from the use of a vibration dampening gasket. Accordingly, in some embodiments, the vibration dampening gasket is utilized on only some of the impact plates that receive the greatest number of bullet impacts. In other embodiments, the vibration dampening gasket is utilized on all or substantially all of the impact plates.

Moreover, to the extent that a particular bullet trap design benefits from negative air pressure (vacuum) within the bullet trap chamber to prevent dispersion of toxic lead dust, some embodiments of the present invention contemplate that the gasket is continuously disposed and provides an airtight seal between one or more, and in some instances all, of the impact plates and the support frame.

In some embodiments, the vibration dampening gasket isolates the one or more impact plate from the plurality of support frames. In some embodiments, the vibration dampening gasket comprises a long strip of material that is laid flat on the support frame flange on which the impact plates will be positioned. The long strip of material may be flattened, or may be rounded or rectangular in shape. In some embodiments, the vibration dampening gasket isolates the one or more impact plate from the flange surface, while the ends of the impact plates are not isolated from the main body of the support frame and may actually touch the support frame. One skilled in the art will appreciate, however, that an impact plate will transmit significantly less kinetic energy to the main body of the support frame, which is positioned perpendicular to the long axis of the impact plates, since a bullet impact to the impact plate will result in the end of the impact plate simply sliding along the surface of the support frame main body. Accordingly, there is less need for the end of the impact plates to be isolated from the support frame. However, in some embodiments, a vibration dampening gasket or an additional vibration dampening gasket, may also be positioned so that it is between the end of the impact plate and the main body of the support frame, so that the impact plate is isolated in its entirety from the support structure.

In yet another embodiment, the gasket is continuously disposed and provides an airtight seal between the one or more impact plate and the support frames. It is understood, of course, that the gasket may also be discontinuously disposed or positioned between the impact plates and the support frame for purposes of absorbing kinetic energy from the impact of bullets on the impact plates, such that only selected impact plates are isolated from the support frame, or that impact plates have their own individual gaskets (with small spaces between the gaskets of individual impact plates). For example, those impact plates that are impacted by bullets at a higher angle of impact will be subjected to a greater amount of transferred kinetic energy and will therefore have a greater need for vibration dampening gaskets, while other impact plates that are impaceted at a lower or shallower angle of impact will have less kinetic energy transferred and may not require any vibration dampening gaskets at all. Accordingly, the vibration dampening advantages need not require a continuously disposed gasket. However, in the event that it is desirable to provide greater control of negative pressure within the bullet trap system (for purposes of collecting toxic lead dust and preventing human exposure to such dust), some embodiments of the present invention contemplate that the gasket is continuously disposed along the flange of the support frame so as to eliminate sources of airflow from within the bullet containment area to the outside of the bullet trap.

The vibration dampening gasket used in connection with the present invention may comprise any one of a number of different materials that effectively reduce the transmission of kinetic energy from the impact plate to the support frame. The gasket may be comprised of any soft pliable material that absorbs vibrational or kinetic energy and that is sufficiently durable to withstand the weight of the impact plates, which tend to be heavy. By way of example, and not by way of limitation, the gasket may be comprised of a material selected from one or more of the following: closed cell foam made from Neo/EPDM Polymeric blends such as WesLastomer™ closed cell foam, visco-elastic foam made from PER-Elastomer (polyether urethane) such as SLAB SL-030, rubber, plastic, and/or silicone. In some particular embodiments, the gasket is comprised of closed cell foam, such as Weslastomer™ Neo/EPDM Polymeric closed cell foam.

In some embodiments of the present invention, the bullet trap further comprises an air pump configured to provide negative pressure within the containment chamber. As noted above, the use of a vibration dampening gasket of the present invention confers the additional advantage of providing an airtight seal between the impact plate the support frame. Accordingly, an air pump may be used to provide negative pressure or negative airflow within the containment chamber of the bullet trap system so as to direct toxic lead dust laden air from within the containment chamber to a filter for removing such dust from the environment and prevent dissemination of the toxic lead dust outside the bullet trap.

Figure 5:
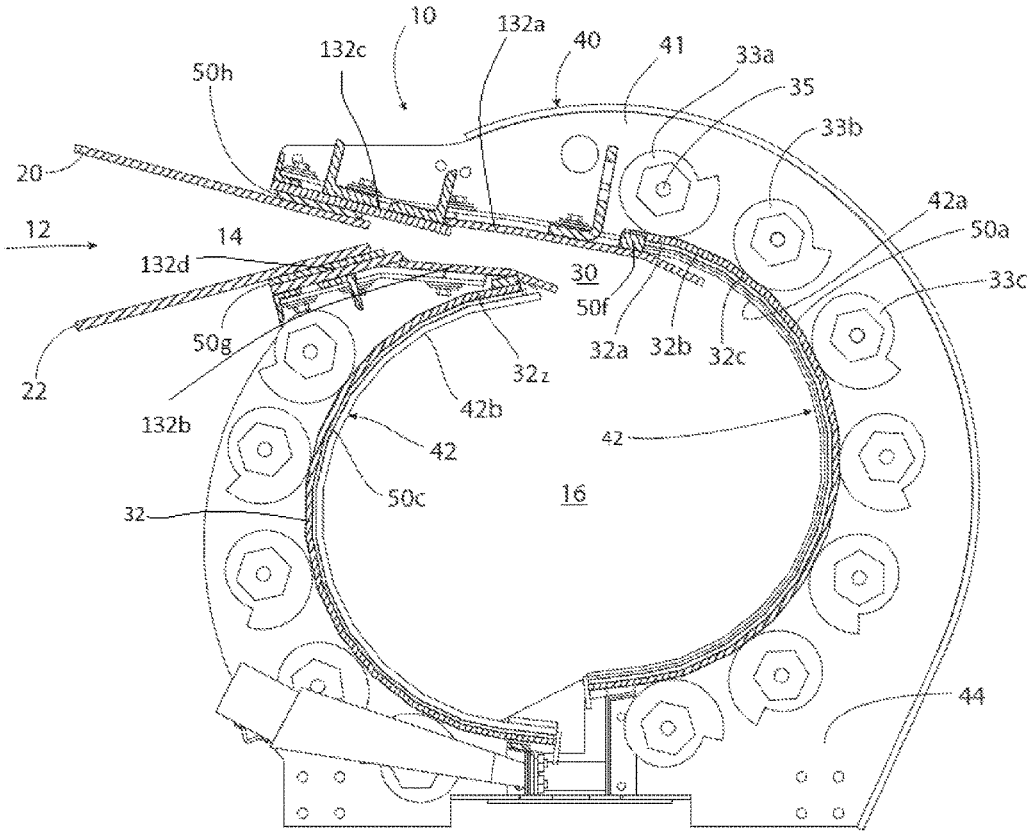
FIG. 5 shows a side section view of a bullet trap device.

In yet another embodiment, the bullet trap of the present invention may further comprise a second gasket positioned between one or more impact plate 32, 132 and one or more upper channel plate 20 and lower channel plate 22 as shown in FIG. 5. The upper channel plate 20 and lower channel plate 22 of the bullet trap system generally directs the trajectory of a bullet into the bullet trap containment chamber 16. In many instances, the upper channel plate 20 or lower channel plate 22 are the first structures to be impacted by a bullet. Although the angle of impact is typically small, since the upper channel plate 20 and lower channel plates 22 are positioned at an acute angle so as to direct bullets toward the entrance to the bullet containment chamber, the upper and lower channel plates are still subject to repetitive bullet impacts, which collectively may cause wear and tear on the bullet trap. Accordingly, the present invention contemplates a bullet trap system in which a vibration dampening gasket is disposed between the upper and lower channel plates, on the one hand, and the support frame to which the channel plates are attached.

As shown in the accompanying figures, the impact plates, etc. include a primary impact plates 132*a*, 132*b*, 132*c*, 132*d* (FIGS. 4-6) along the mouth leading into the containment chamber 16 and other impact plates 32 having impact surfaces 32*a*, 32*b*, 32*c*, etc. defining the chamber. The impact plates 32 are supported by one or more interior support frame(s) 40 having support legs 44. In one embodiment, the support frames 40 comprise a vertical main body 41 with horizontal flanges 42 that are perpendicular to the main body 41. The impact plates forming the impact surfaces are supported by the horizontal flanges 42. In one particular embodiment, for example, the impact plates are supported on the outer surface (the side opposite the containment chamber 16) of flange 42 of the support frame 40. In this embodiment, the impact plates 32 form a series of impact surfaces 32*a*, 32*b*, 32*c*, etc. that curve around to form a generally circular containment chamber 16.

The impact plates 32 can, for example, be secured to the support flame 40 by any suitable means. one particular embodiment, the impact plates 32 are secured to the flange 42 of the support frame 40 by means of a series of "offset" or "asymmetrical" cams 33 that when turned force the impact plates 32 against the outer surface of the flange 42. The asymmetrical cam, when turned, applies a compressive force against the impact plates to force the impact plates against the flange of the support frame and thereby secure the impact plate in place and prevent bullets from passing between the flange and the impact plates. The cams 33 may be pivotably attached to the main body 41 of the support frame 40 by means of bolts 35. Once the impact plates 32 are disposed adjacent the flange 42, the cam device 33 is rotated about bolt 35 and the wider portion of the flange forces the impact plates 32 against the flange 42.

Figure 2:
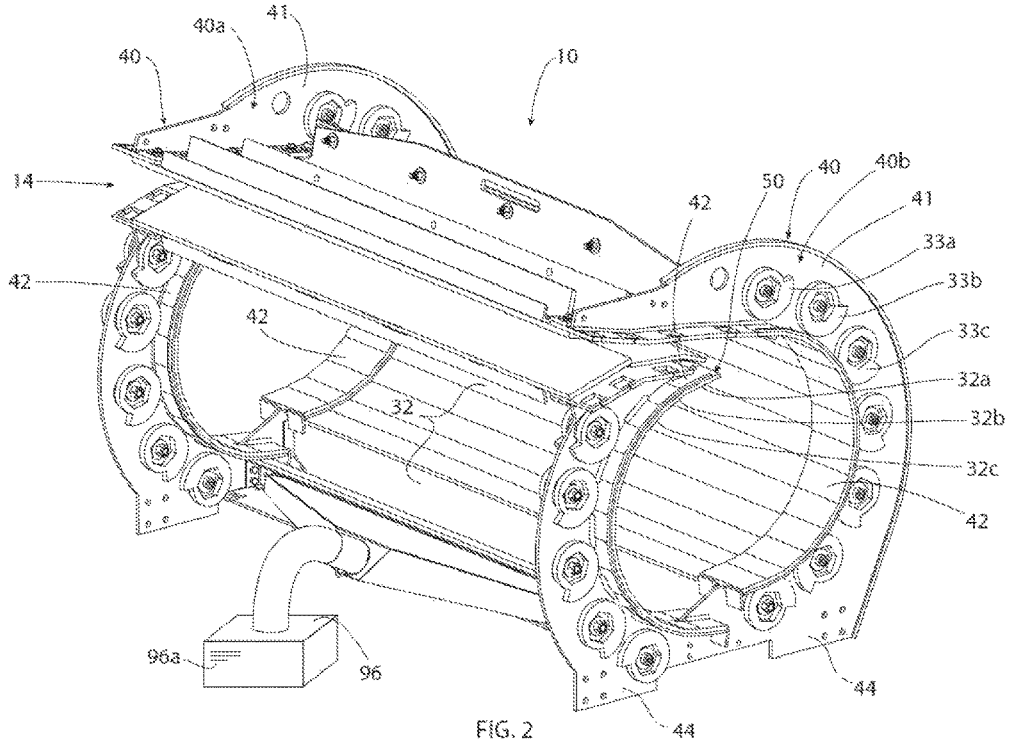
FIG. 2 shows a perspective view of the front of a bullet trap device.

Referring to FIG. 1 and FIG. 2, there is shown a perspective view of a bullet trap generally indicated as 10, made in accordance with the principles of the present invention. FIG. 1 shows the bullet trap from a rear view. FIG. 2 shows the bullet trap from a front view. The bullet trap 10 includes a channel 14 through which bullets enter a containment chamber 16. Also shown are impact plates 32 with surfaces shown individually as 32*a*, 32*b*, 32*c* and so forth) disposed between support frames 40 (shown in FIGS. 1 as 40*a* and 40*b*) which are configured to support the plurality of impact plates 32. For convenience in the drawings, only impact plate surfaces 32*a*, 32*b*, and 32*c* are numbered; however, it is understood from the drawings that additional impact plates are present in a sufficient number to form the impact surface of the containment chamber of the bullet trap. The numbering of impact plate surfaces 32*a*, 32*b*, 32*c* and 32*z* do not refer to any particular impact plate, and such numbers are used only to indicate that a plurality of impact plate surfaces are shown and utilized. As further shown in FIGS. 1 and 2, the support frames 44 include a main body 41 from which extend a flange 42 that supports each of the impact plates 32. The impact plates 32 are placed on the outside surface of the flange 42 and are then forced against the flange 42 by cams 33. Gaskets, such as 50*a*, are placed at the location of 50, on the outer surface of flange 42. In accordance with the present invention, vibration dampening gaskets are disposed between the flange 42 and the impact plates 32.

Figure 3:
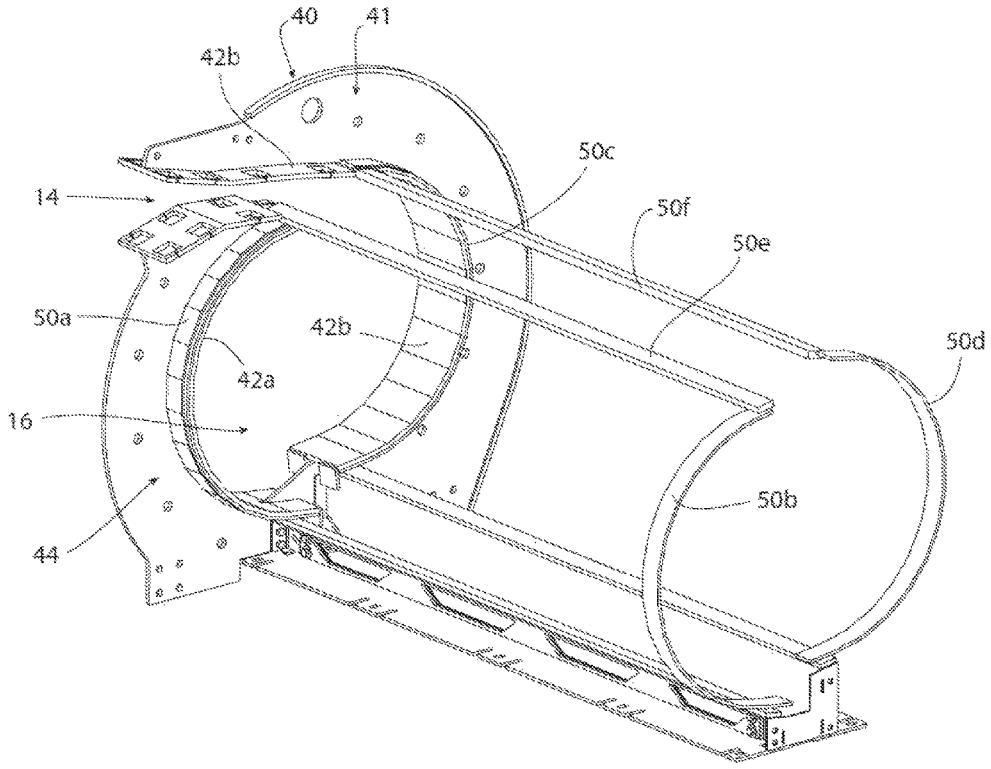
FIG. 3 shows a perspective view of possible locations of vibration dampening gaskets.

FIG. 3 shows more particularly the vibration dampening gaskets 50*a*, 50*b*, 50*c*, 50*d*, 50*e* and 50*f* (shown with solid lines) and their location in a bullet trap system (shown with broken lines), without much of the supporting structure of the flange and support frame. As shown in FIG. 3, vibration dampening gasket 50*a* is positioned on the outer surface of the flange 42*a* (underneath/behind the gasket 50*a*) of the front of the support frame 44. Vibration dampening gasket 50*b* is positioned on the outer surface of the flange of the opposing front support frame (not shown). Similarly, vibration dampening gasket 50*c* is positioned on the outer surface of the flange 42*b* of the rear of the support frame 44, and vibration dampening gasket 50*d* is positioned on the opposing support frame (not shown). Once gaskets are positioned on the outer surface of the flanges of the support frame, the impact plates 32 can be placed on top of the gaskets and the impact plates secured to the support frame by such means as the tightening cams 33 (referred to collectively by reference number 33, and identified individually by reference numbers 33*a*, 33*b*, 33*c* and so forth).

In addition, a vibration dampening gasket may also be positioned between a support frame flange and the upper and lower channel plates. For example, as shown in FIG. 5, gasket 50*a* is positioned between the support frame flange 42*a* and the impact plate 32 having impact surface 32*z* and so forth on the front portion of the support frame. On the rear portion of the support frame, gasket 50*c* is positioned between the support frame flange 42*b* and impact plates 32 on the outer surface of the support frame flanges 42.

Figure 4:
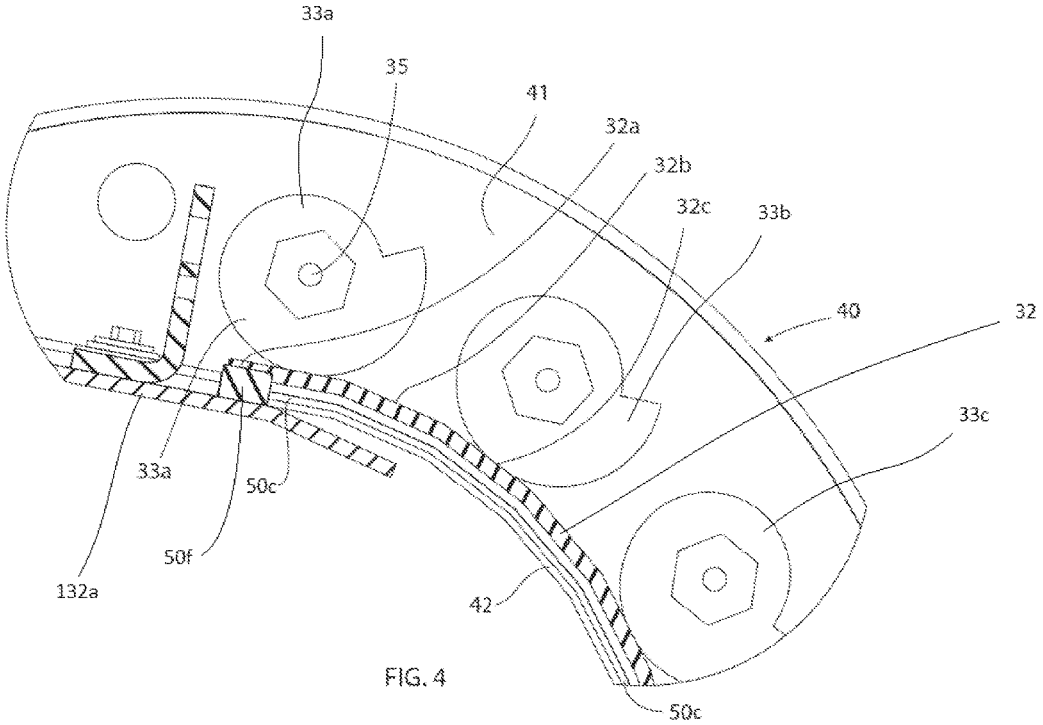
FIG. 4 shows a expanded cutaway section of a bullet trap showing a gasket disposed between the support frame and the impact plate.

FIG. 4 shows an expanded view of the positioning of the gasket 50 on one support frame flange 42. Specifically, FIG. 4 shows the support frame 40, comprising a main body 41 and a flange 42. A gasket 50 is placed on the outer surface of the flange 42, and impact plates 32*a*, 32*b*, 32*c*, etc. are positioned on top of the gasket 50. Cam 33*a* is then used to secure the impact plates in place.

FIG. 5 shows a side section view of the bullet trap with a vibration dampening gasket. As shown in FIG. 5, the channel 14 is defined by an upper plate surface, which may be formed by a plurality of channeling plates 20 connected to one another between a series of support frames, and a lower plate surface, which also may be formed by a plurality of channeling plates 22 connected to one another between a series of support frames. The upper plate 20 and lower plate surface 22 are arranged on complementary acute angles to the generally horizontal zone of projectile travel. Alternatively, plates 20 and 22 may not extend into the mouth of the chamber, but may instead abut against the mouth plates at the same angle, between which are positioned gaskets 50*g* and 50*h*. As a bullet is fired it travels in a direction 12 from a wide opening in the channel 14, to a narrow opening and through the ingress 30 into the containment chamber 16. If a projectile is on a trajectory which is lower than the narrow opening 30, it is deflected by the lower plate surface 22 of the channel 14 back toward a conforming path. If a projectile is on a trajectory which is higher than the narrow opening 30 it is deflected by the upper plate surface 20 of the channel 14 back toward a conforming path. The projectile is guided into the narrow opening 30 by the upper and lower plates which are at generally acute angles (from about 10 degrees to about 30 degrees, but more typically about 15 degrees) to each other, so that the projectile remains intact while traveling through the channel and into the chamber. Vibration dampening gasket 50*e* may also be positioned between the impact plate 132*b* in the mouth of the chamber and impact plate 32*z*.

As the projectile travels between the upper plate 20 and the lower plate 22 and through the narrow opening 30, it enters the containment chamber 16 and impacts the surface of one of the primary impact plates 132. As with the channel 14, the interior of the containment chamber is formed by a plurality of impact plates 32, which are secured to the main support frame 40 in a horizontal line.

The impact plate 32 may be at an equal or greater angle of incidence with the generally horizontal zone of projectile travel so that the impact with the impact plate 32 is of equal or greater force than the general impact the projectile may have had with either the upper 20 or lower 22 channel plate. The result of projectile impact with the primary impact plate 132 is that the bullet or fragments thereof are deflected into in a sequence of impact plate surfaces which may be at an angle of incidence that is greater than the angle of impact at the primary point of impact. As with the other plate surfaces, the impact plate surfaces 34 are preferably formed by a plurality of impact plates held together in generally horizontal lines.

A terminal impact plate surface 32*z* terminates adjacent the chamber entrance 30. Thus, the impact plate surfaces 32 form a series of more or less continuous impact surfaces extending from the top of the chamber ingress 30, around to the bottom of the chamber entrance. Likewise, by having the surfaces of the channel 14 and containment chamber 16 formed by horizontally juxtaposed plates, a channel 14 and containment chamber 16 can be formed with considerable width without the use of sidewalls. The absence of sidewalls allows the bullet trap 10 to be used for cross-shooting, i.e. shooting at a variety of angles, without the disadvantages sidewalls provide.

Not only does the above system save on manufacturing costs, as there is no welding, but it also allows the plates to move slightly each time they are impacted by a bullet, thereby partially absorbing some of the kinetic energy of the bullets. This in turn tends to knock lead debris from the plates, rather than allowing the debris to accumulate. This system also allows the plates to be secured without any mounting hardware (screw heads, nuts, etc.) to be exposed to the path of the bullet, which would damage these pieces and possibly cause the plate to become loose or dislodge. It is understood, of course, that the impact plates may be secured to the support frame by any one of many other different techniques known to those skilled in the art. For example, the impact plates may be bolted onto the flange by means of holes in the impact plate and the flange, with a nut and bolt assembly inserted through the holes. Alternatively, the impact plates may be secured to the support frame by means of a clamp assembly. Any other structures or techniques for joining plates may also be used.

An additional advantage of this approach is that the impact surfaces can be readily replaced. For example, the primary impact plates 132*a-c* is prone to wear faster than other impact surfaces because bullets impact that surface at a higher velocity and frequency. If the bullets cause wear of the primary impact surface, the operator of the range need only disassemble and remove the primary impact surface. A new primary impact surface can then be added and reassembled.

In addition to holding the support frame 40 in place, the support legs 44 support the weight of the trap. This is important because the bullet trap of the present invention is generally not built as individual containment units and then brought together. Rather, a plurality of open segments are attached to one another to form a large containment chamber having extended width without sidewalls, or elongate impact surfaces are formed and then they are placed in an array to form an elongate bullet containment chamber. This distance is greater than eight feet wide and preferably much wider, i.e. 20 to 40 feet wide. Such width allows for a much greater angle of cross-shooting while minimizing the risks of ricochet, etc. It also helps to minimize costs, as it reduces the number of support frames required.

Also shown in FIG. 5, the support frames 40 and the impact plates 32 collectively form a containment shell which is disposed about the containment chamber 16. Because the containment chamber 16 is formed by plate arrays 32 that are not fixedly attached together, small amounts of lead dust can escape between the arrays. The containment gaskets, however, prevent the dust from leaking into the atmosphere surrounding the trap. If desired, a vacuum system 96 can be disposed in communication with the containment shell 32 or directly into the containment chamber 16. Vacuum filter 96*a* filters the toxic lead dust from the airflow.

Figure 6:
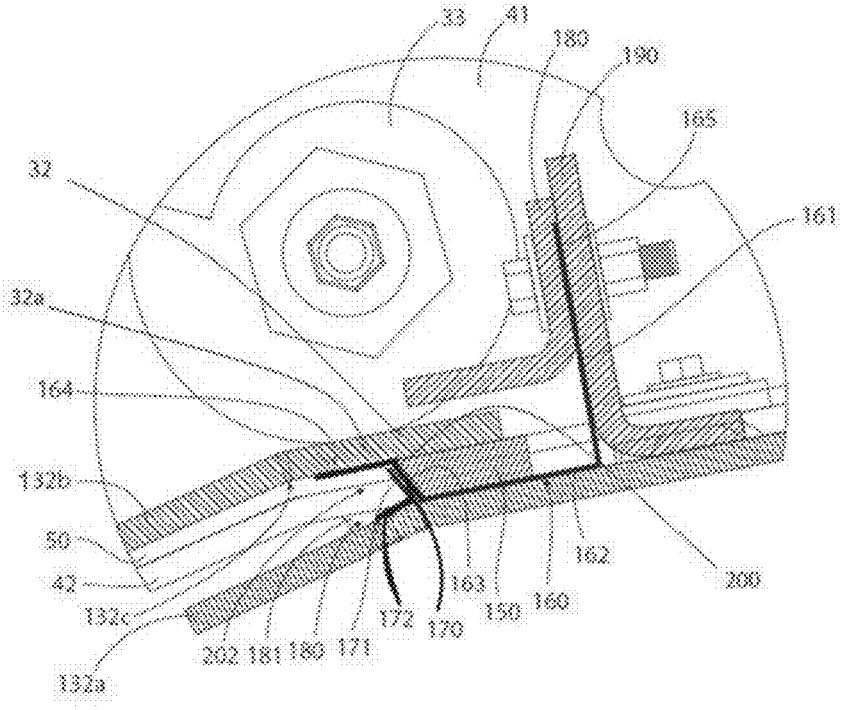
FIG. 6 shows a side sectional view of a gasket guard assembly taken from an opposing side as FIG. 5.

In another embodiment, shown in FIG. 6, the present invention further includes a gasket guard that functions to protect the top mouth gasket 150 situated between the upper surface of the primary impact plate 132*a* and the lower surface of the back shell (i.e. impact plate 32 adjacent impact surface 32*a*). As shown in FIG. 5, the shell 32 (corresponding to the top mouth shell 132*a* and back shell 32) is comprised of a plurality of smaller impact plate surfaces 32*a*, 32*b*, etc. that are press fit against the flange 42 of the main body 41. Because each impact plate surface 32*a*, 32*b*, etc. has an exposed edge where the impact plate surfaces abut each other (Seen in FIG. 6, reference number 132*c*), there is often back splatter from bullet fragments that enter the gap between the top mouth 132*a* and the back shell 132*b* from behind. The back splatter from bullet fragments results in damage to the top mouth gasket 150, significantly reducing its life span and increasing the cost of maintenance caused by frequent replacement of the top mouth gasket 150.

Figure 7:
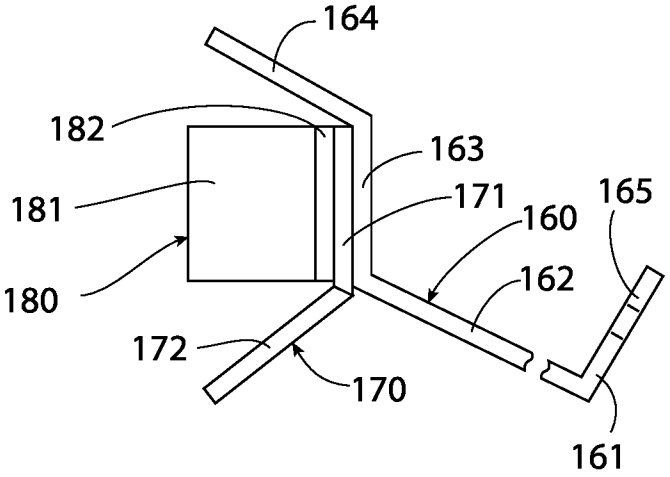
FIG. 7 shows an enlarged side view of a gasket guard assembly of FIG. 6.

As shown in FIG. 6, one aspect of the present invention is a bullet fragment guard 200, which is positioned between the top mouth gasket 150 and the surfaces of impact plates which form the back shell 132*b*, from which bullet fragments ricochet, and primary impact plates which form the top mouth shell 132*a*. The bullet fragment guard thus protects the top mouth gasket 150 from damage caused by bullet fragments ricocheting off of the impact plates. In one embodiment, the bullet fragment guard 200 comprises a U-shaped channel that is positioned between the top mouth gasket 150 and the impact plates forming the top mouth shell 132*a*, and back shell 132*b*, etc. and is compressed between the top mouth shell and the back shell. Thus, as manufactured, the upper arm 164 and lower arm 172 of the bullet fragment guard 200, are at an angle greater than 0° (i.e., not parallel) to each other, as shown in FIG. 7. At the time of installation, the upper arm 164 and lower arm 172 of the bullet fragment guard 200 are compressed so as to create a tight seal with the respective impact plates 32 that is resistant to penetration by bullet fragments. Similarly, the side tabs 180 located on each end of the bullet fragment guard 200 are also angled outwardly so that upon installation they are compressed inwardly to form a tight seal against the flanges 42 on each main body 41 at each end of the bullet fragment guard 200. In addition, the relative thickness of the material of the gasket guard, combined with the compression of the two arms of the U-shaped piece, further allows the gasket guard to expand and contract relative to impact plates of the top mouth shell and back shell 132*a* and 132*b*. This allows the guard to continue to provide the seal as the shell moves.

In one embodiment shown in FIGS. 6 and 7, the U-shaped channel 202 is formed by integrating two or more components into a single weldment comprising the U-shaped channel 202 (formed by the upper arm 164, a lower arm 172 and a back or bottom portion 204), the horizontal extension 162 and a vertical support arm 161 that is bolted on to a support bracket 165. The vertical arm 161 may be connected to and secured to the first upright 190 of the top mouth guard, for example, with a bolt (as shown) or by any other attachment mechanism, such as welding.

Figure 8:
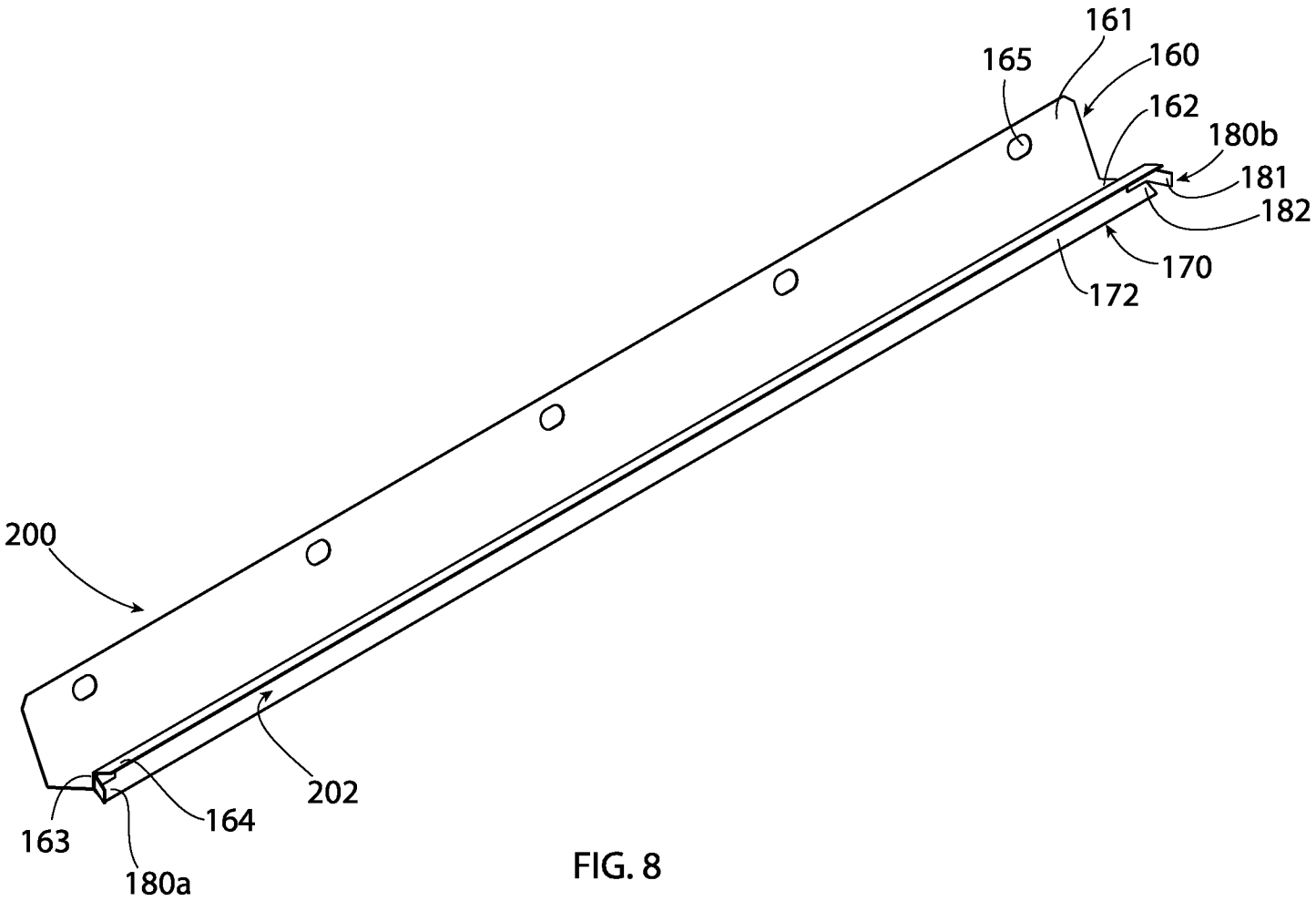
FIG. 8 shows a perspective view of a gasket guard assembly of FIGS. 6 and 7.

The particular embodiment shown in FIGS. 6, 7 and 8 shows a bullet fragment guard 200, made from three separate pieces that are welded together to form a single weldment structure. The three separate pieces shown include (1) an impact plate guard 160 (which includes the horizontal upper arm 164, the vertical portion 163, the horizontal extension 162 and the vertical support arm 161 that is bolted onto the bracket 190), (2) a top mouth guard 170 (which includes a horizontal lower arm 172 and a vertical portion 171 that is welded to vertical portion 163 of the impact plate guard 160), and (3) a side tab guard 180 (which includes an extension arm 181 and a support arm 182 that is welded to the vertical portion 171 of the top mouth guard 170). Each of the three separate pieces are fabricated from a single sheet of metal that is cut into the desired shapes, bent as shown in the Figures, and then welded together. When welded together, the combined pieces form a U-shaped channel that functions as the main guard (together with the upper and lower extension arms), the horizontal extension 162 that extends back to the bracket 190, and the vertical support arm 161 that is bolted onto the bracket 190.

In one embodiment, the horizontal upper arm 164 of the main bracket 160, and the Horizontal lower arm 172 of the secondary bracket 170, which form the two arms of the U-shaped channel, are initially angled such that they are non-parallel or at an angle greater than 0 degrees, so that when the two arms are compressed between the top mouth 132*a* and the back shell 132 they form a tight seal that is impervious to bullet fragments.

In another embodiment, the bullet trap gasket guard comprising the U-shaped channel, horizontal extension and vertical support arm, consists of two separate pieces that are welded together. For example, as shown in FIG. the U-shaped channel, horizontal extension and vertical support arm may consist of a first piece comprising an upper portion of the U-shaped channel, a back support of the U-shaped channel, the horizontal extension and the vertical support arm; and a second piece comprising a back portion of the U-shaped channel and a bottom portion of the U-shaped channel; wherein the back portion of the U-shaped channel of the second piece is fixed to the back support of the U-shaped channel of the first piece.

In other embodiments, the side tabs 180, instead of being fabricated from a separate piece of metal, are made from the same piece of metal as the impact plate guard 160.

In another embodiment, the side tabs 180, instead of being fabricated from a separate piece of metal, are made from the same piece of metal as the top mouth guard 170.

Thus, there is disclosed an improved bullet trap. Those skilled in the art will appreciate numerous modifications which can be made without departing from the scope and spirit of the present invention. The appended claims are intended to cover such modifications.

The invention claimed is:

1. A bullet trap comprising:

a plurality of support frames;

a first impact plate having opposing ends supported by the support frames so that the first impact plate extends between the plurality of support frames thereby forming a part of a containment chamber for decelerating bullets between them; and a first gasket disposed between one end of the first impact plate and one of the plurality of support frames, wherein the first gasket absorbs kinetic energy transferred from the first impact plate;

a second impact plate, the second impact plate being a primary impact plate for directing bullets as the bullets move into the containment chamber;

a second gasket positioned between the first impact plate and the second impact plate; and a gasket guard disposed adjacent the second gasket, wherein the gasket guard includes an upper arm and a lower arm and wherein the upper arm and the lower arm are compressed toward one another between the first impact plate and the second impact plate.

2. The bullet trap according to claim 1, wherein the first gasket isolates the first impact plate from said one of the plurality of support frames.

3. The bullet trap according to claim 1, wherein the first gasket is continuously disposed and provides an airtight seal between the first impact plate and the one of the support frames.

4. The bullet trap according to claim 1, wherein the first gasket is comprised of a material selected from one or more of the following: closed cell foam, rubber, plastic and silicone.

5. The bullet trap according to claim 4, wherein the material is closed cell foam.

6. The bullet trap according to claim 1, further comprising a third impact plate and wherein the first impact plate, third impact plate, plurality of support frames and first gasket form the containment chamber.

7. The bullet trap according to claim 6, wherein the bullet trap further comprises an air pump configured to provide negative air flow from within the bullet trap to an air filter configured to remove particulate matter.

8. The bullet trap according to claim 1, wherein the bullet trap defines the containment chamber having an opening and a bracket disposed adjacent the opening, and wherein the gasket guard is attached to the bracket.

9. The bullet trap according to claim 1, wherein the gasket guard includes a U-shaped channel.

10. The bullet trap according to claim 1, wherein the at first impact plate has a first end which is disposed on the first gasket so as to form a seal between the end of the first impact plate and the support frame, and further comprising a second support frame, the first impact plate having a second end and a third gasket, the third gasket being disposed between the second end of the first impact plate and the second support frame for creating a seal between the second support frame and first impact plate.

11. A bullet trap comprising:

a first support frame;

a gasket disposed on the at least one support frame; and at least one impact plate disposed against the gasket; and a fastener disposed in engagement with the at least one impact plate for forcing the at least one impact plate into engagement with the gasket, wherein the fastener comprises an asymmetrical cam attached to the first support frame.

12. The bullet trap according to claim 11, wherein the first support frame includes a flange extending outwardly and wherein the gasket is disposed on the flange and forms a seal between the flange and the at least one impact plate.

13. The bullet trap of claim 11, wherein the bullet trap includes a channel for directing projectiles into a containment chamber formed by the at least one impact plate, the channel being defined by an upper plate and a lower plate which slope toward one another and wherein the bullet trap comprises a gasket between the first support frame and at least one of the upper plate and the lower plate.

14. The bullet trap of claim 11, wherein the at least one impact plate includes a first one or more impact plates forming a rear portion of a generally cylindrical containment chamber and a second one or more impact plates forming a front portion of the generally cylindrical containment chamber, and wherein the gasket is disposed between all of the first one or more impact plates forming the rear portion and the first support frame.

15. The bullet trap of claim 14, further comprising a gasket disposed between all of the second one or more impact plates forming the front portion and the first support frame.

16. A bullet trap comprising:

a first support;

an impact plate attached to the first support;

a gasket disposed adjacent the impact plate for damping vibrational energy in the impact plate; and a gasket guard disposed adjacent the gasket, the gasket guard having a u-shaped channel disposed facing away from the gasket for deflecting bullet fragments away from the gasket.

17. The bullet trap according to claim 16, wherein the gasket guard includes a horizontal extension extending away from the it-shaped channel and a vertical support arm.

18. The bullet trap of claim 11, further comprising a second support frame and a second gasket disposed thereon, the gasket being held between an end of the at least one impact plate opposite the one end and the second support frames so that seals are formed between the opposing end of the at least one impact plate and the support frame and the second support frame.

* * * * *